United States Patent [19]

Nakanishi et al.

[11] Patent Number: 4,686,021

[45] Date of Patent: Aug. 11, 1987

[54] LITHOGRAPHIC SUPPORT AND PROCESS OF PREPARING THE SAME

[75] Inventors: Haruo Nakanishi; Hisao Ohba; Hirokazu Sakaki, all of Kanagawa, Japan

[73] Assignee: Fuji Photo Film Co., Ltd., Kanagawa, Japan

[21] Appl. No.: 719,086

[22] Filed: Apr. 2, 1985

[30] Foreign Application Priority Data

Apr. 2, 1984 [JP] Japan ..... 59-065631
Apr. 2, 1984 [JP] Japan ..... 59-065632

[51] Int. Cl.[4] ..... C25F 3/04
[52] U.S. Cl. ..... 204/129.75
[58] Field of Search ..... 204/129.75

[56] References Cited

U.S. PATENT DOCUMENTS 4,502,925 3/1985 Walls ..... 204/129.75
4,547,274 10/1985 Ohoshi ..... 204/129.75
4,584,067 4/1986 Hutchins ..... 204/129.75

*Primary Examiner*—T. M. Tufariello
*Attorney, Agent, or Firm*—Sughrue, Mion, Zinn, Macpeak and Seas

[57] ABSTRACT

A process of preparing a lithographic support, the lithographic support produced by the process and a presensitized plate are disclosed. The process comprises chemically graining at least one surface of an aluminium plate with an aqueous solution containing chloride, fluoride or a mixture thereof and thereafter electrochemically graining the surface. The presensitized plate comprises a lithographically suitable light-sensitive coating on the lithographic support.

18 Claims, 3 Drawing Figures

LITHOGRAPHIC SUPPORT AND PROCESS OF PREPARING THE SAME

FIELD OF THE INVENTION

The present invention relates to a process for preparing a lithographic support and, particularly, to a process for preparing a lithographic support which comprices chemically graining an aluminium plate and thereafter electrochemically graining it to form superimposed or complex grains on the surface thereof.

BACKGROUND OF THE INVENTION

Hitherto, as lithographic supports, aluminium plates have been widely used. However, with such supports it is necessary to carry out roughing of the surface, so-called graining, for the purpose of improving adhesion to a light-sensitive layer and giving a water retention property. Graining is an important process for producing lithographic plates because it has a great influence upon the aptitude for a plate making process or printing durability in the case of carrying out printing by mounting on an offset printing press after making a printing plate.

Graining can be carried out by mechanical graining which utilizes sand-blasting, ball-graining, wire-graining or brush graining by a nylon brush and abrasives/-water slurry, chemical graining which comprises etching a special aluminium alloy with alkali as described in Japanese Patent Application (OPI) No. 61304/76 (The term "OPI" as used herein refers to a "published unexamined Japanese Patent Application".), electrochemical graining as described in, for example, Japanese Patent Applications (OPI) No. 146234/79 and Japanese Patent Publication No. 28123/73, and combinations of a mechanical graining process and electrochemical graining as described in, for example, U.S. Pat. Nos. 4,476,006 and 4,477,317 have been known.

However, in the case of ball-graining which is one of typical mechanical graining processes, there are many factors requiring skill, such as selection of the material of balls, the kind of abrasives, the control of water-amount, and the like, and the operation can not be carried out continuously. In the case of wire-graining the grain texture is not uniform. On the other hand, brush-graining is a process of improving the above described processes, but there are disadvantages in that the texture is generally simple shallow grains and scratches caused by a revolving brush are left on the surface. In addition, directionality of the grains appears and nonimage parts are easily stained.

In the chemical graining process described in Japanese Patent Application (OPI) No. 61304/76, since an aluminium alloy plate containing 1.6 to 2.5% of manganese should be used, there are disadvantages in that it is hard to get such a material or stain appears on the prints depending upon printing conditions and thus deteriorates the quality.

On the other hand, according to an electrochemical graining process, uniform grains having a large average surface roughness as compared with that in the prior mechanical graining processes such as ball-graining or brush-graining, etc. can be obtained. However, it has a disadvantage of having a very narrow condition. When conditions such as the composition of the electrolyte, the temperature thereof, or the electric condition such as electric current density, etc. are kept constant, products having uniform performances can be easily obtained, but the electrolytic conditions therefor are in a very narrow range and it is very difficult to control each condition so as to be in a suitable range. Moreover, when graining of the surface of an aluminium plate is carried out by only the electrochemical graining process, the cost of electric power consumed is very great and the rate of electric power in the production cost becomes great. Therefore, there is a problem from the viewpoint of economy.

On the contrary, in a process wherein brush graining and electrochemical graining are combined, as described in U.S. Pat. Nos. 4,476,006 and 4,477,317, the directionality of grains disappears and uniform roughness is obtained and consumption of electric power is small. However, if the brush graining is carried out for a long time with one brush, there are problems on continuous operation, namely, uniform quality can not be obtained because of abrasion by the brush, and operation should be stopped when the brush is worn out. Moreover, there is a problem that only a lithographic printing plate easily causing stain on the nonimage part is obtained because of the influence of brush-graining.

SUMMARY OF THE INVENTION

As a result of earnest studies, for the purpose of finding a process of preparing a support capable of obtaining a lithographic plate without using special aluminium alloy, by which uniform roughness can be comparatively easily obtained and continuous productivity for a long time is excellent and the nonimage part is hard to stain in the case of carrying out printing, the present inventors have found a process for preparing a lithographic support which comprises chemically graining at least one side of an aluminium plate with an aqueous solution containing chloride, fluoride or a mixture thereof and, thereafter, electrochemically graining it.

BRIEF DESCRIPTION OF THE DRAWINGS

The drawings show electric voltage wave forms of electric currents obtained as alternating wave form electric currents.

DETAILED DESCRIPTION OF THE INVENTION

Figure 1:
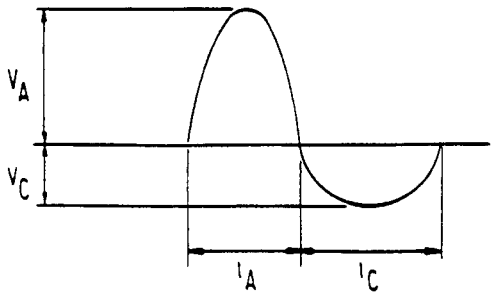
FIG. 1 shown an alternating wave form electric current using a sinusoidal wave.

Aluminium plates used in the present invention include pure aluminium plates and aluminium alloy plates, and those produced by conventional continuous casting are used. As aluminium alloys, various kinds of alloys can be used. For example, alloys composed of metals such as silicon, copper, manganese, magnesium, chromium, zinc, lead, bismuth, nickel, etc. and aluminium are used. These compositions contain impurities in an amount which can be disregarded in addition to some amount of iron and titanium.

The aluminium plate is first subjected to chemical graining. If necessary, it may be subjected to cleaning processing for the purpose of removing oils and fats, rust, dust, etc. stickling to the surface of the aluminium plate, piror to chemical graining. Examples of the cleaning processing include solvent degreasing with trichlene, etc. and alkali etching degreasing with sodium hydroxide, etc. In the case of carrying out alkali etching degreasing with sodium hydroxide, desmutting processing (processing by immersing in 10–30% nitric acid) is generally additionally carried out in order to remove smut, because smut is formed.

The etching solution used for the chemical graining is an aqueous solution containing fluoride, chloride or a mixture thereof.

As fluoride, for example, hydrogen fluoride, ammonium fluoride, sodium fluoride, silicon fluoride, fluoroboric acid, etc. are used. If necessary, it may contain one or more of inorganic acids such as nitric acid, sulfuric acid, hydrochloric acid, etc., alkalis such as sodium hydroxide, etc., salts of inorganic acid such as copper sulfate, ammonium nitrate, lead nitrate, ammonium sulfate, etc.

As chloride, for example, ferric chloride, ammonium chloride, calcium chloride, nickel chloride, sodium chloride, copper chloride, etc. are used. When acids such as phosphoric acid, sulfuric acid, nitric acid, et. are used together, uniform grains are obtained. It is particularly advantageous to use the chloride together with phosphoric acid because more uniform grains are obtained in a short time and the reduction of plate thickness is small.

It is preferred that the etching solution contains fluoride or chloride in an amount of 3 to 80% by weight, preferably 10 to 60% by weight. Additives used together with fluoride or chloride are preferred to be added in an amount of from 0.1 to 70% by weight based on the total weight of the etching solution.

In a particularly preferred embodiment of the present invention, an aqueous solution containing ferric chloride and phosphoric acid is used as the etching solution. In this case, the concentration of ferric chloride contained in the etching solution is preferred to be in a range of generally 3 to 80% be weight, and it is preferably selected between a range of 20 to 60% by weight. On the other hand, phosphoric acid is preferred to be contained in the etching solution in a range of 10 to 80% by weight. With reducing the concentration of phosphoric acid from 10% by weight, the processing time requiring for obtaining uniform grains becomes long and the etching amount of aluminium increases to cause a reduction of the thickness of the aluminium plate. On the other hand, with increasing the amount beyond 80% by weight, it becomes difficult to form the desired grains and a glossy face is formed. Therefore, a preferable concentration of phosphoric acid is selected from a range of 40 to 70% by weight. The etching solution containing ferric chloride and phosphoric acid may contain, if necessary, various known additives. For example, there are chlorides such as ammonium chloride, calcium chloride, nickel chloride, sodium chloride, aluminium chloride, copper chloride, etc. and acids such as hydrochloric acid, nitric acid, sulfuric chromic acid, acetic acid, etc. Such additives are preferred to be added in an amount of from 0.1 to 70% by weight based on the total weight of the etching solution.

It is preferred that the chemical graining with the etching solution is carried out so that the surface roughness of the center line (Ra) is in a range of 0.3 to 1.0 $\mu$m.

In order to obtain such a surface roughness, it is advantageous to process with a etching solution having a temperature of 20° C. to 100° C. for a processing time of 10 to 120 seconds. The aluminium plate is brought in contact with the etching solution by a method, for example, jetting by spraying or immersion, etc.

The surface of the chemically grained aluminium plate is generally subjected to a desmutting processing, because smut if formed by an etching reaction. It is advantageous to carry out desmutting processing, because subsequent electrochemical graining can be carried out uniformly and effectively. The desmutting processing is carried out by contacting the surface of the chemically grained aluminium plate with an aqueous solution of acid or alkali by a method such as immersion processing, etc. Examples of acid include phosphoric acid, sulfuric acid, chromic acid, etc. Examples of alkali include sodium hydroxide, potassium hydroxide, sodium tertiary phosphate, potassium tertiary phosphate, sodium aluminate, sodium metasilicate, sodium carbonate, etc. Of these, use of the aqueous solution of alkali is preferable, because an etching rate is high. Generally, the processing is carried out with an aqueous solution containing 0.5 to 40% by weight of the acid or the alkali at at liquid temperature of 20° to 100° C. for 1 to 300 seconds. In the case of using an aqueous solution of alkali, the surface of the aluminium is dissolved to form insoluble residues. Therefore, it is further processed with phosphoric acid, nitric acid, chromic acid, or a mixed acid containing two or more of them, to remove insoluble residues. Thus desmutting processing is concluded.

The aluminium plate after conclusion of the above described processings is then subjected to electrochemical graining. The electrochemical graining is preferred to be carried out with an alternating current in an acid electrolyte.

In the following, preferred embodiments of the electrochemical graining process used in the present invention are illustrated in detail.

The alternating electric current used has a wave form obtained by exchanging alternatively positive and negative polarities, which includes not only commercial alternating currents such as sinusoidal wave monophase alternating current or sinusoidal wave threephase alternating current, but also electric currents such as a rectangular wave current or trapezoidal wave current, etc. Hereinafter, they are referred to collectivity as "alternating wave form electric currents".

Figure 2:
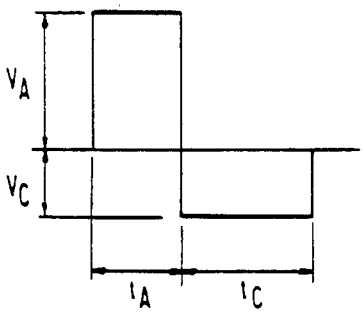
FIG. 2 shows an alternating wave form electric current using a rectangular wave.
Figure 3:
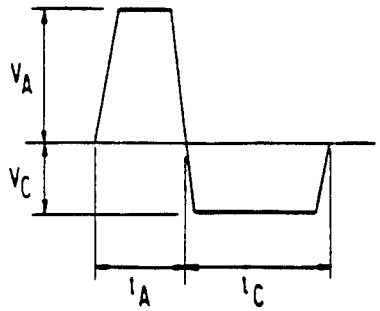
FIG. 3 shows an alternating wave form electric current using a trapezoidal wave. In the drawings, ($V_A$) means anode time electric voltage, (Vc) means cathode time electric voltage, ($t_A$) means anode time, and ($t_C$) means cathode time.

In a preferred embodiment of the present invention, as asymmetric alternating wave form electric current is applied to the aluminium plate in an acid electrolyte in such a manner that the quantity of anode time electricity ($Q_A$) is larger than the quantity of cathode time electricity ($Q_C$). A particularly preferred ratio of $Q_C/Q_A$ is in a range of 0.3 to 0.95. In this case, it is preferred to apply an alternating wave form electric current to the aluminium plate in such a manner that the anode time electric voltage is higher than cathode time electric voltage and the quantity of anode time electricity is larger than the quantity of cathode time electricity. In the drawings, wave forms of alternating wave form electric voltages are shown. In FIG. 1, there is an alternating wave form electric voltage using a sinusoidal wave. In FIG. 2, there is an alternating wave form electric voltage using a rectangular wave. In FIG. 3, there is an alternating wave form electric voltage using a trapezoidal wave. Any wave form can be used in the present invention.

The electric voltage applied to the aluminium plate is about 1 volt to about 50 volts, preferably 2 to 30 volts.

The electric current density is about 10 amperes/dm$^2$ to about 100 amperes/dm$^2$, preferably 10 to 80 amperes/dm$^2$. The quantity of anode time electricity is about 10 coulombs/dm$^2$ to about 3000 coulombs/dm$^2$, preferably 50 to 1800 coulombs/dm$^2$. The temperature of the electrolyte is about 10° C. to about 45° C., preferably 15° to 45° C.

On the other hand, as an acid electrolyte, hydrochloric acid, nitric acid or a combination of them is preferred to use. The concentration of it is preferred to be selected from a range of about 0.5% by weight to 5% by weight. To the electrolyte, it is possible, if necessary, to add corrosion inhibitors (or stabilizers) such as chloride, nitrates, monoamines, diamines, aldehydes, phosphoric acid, chromic acid, boric acid, etc.

Generally, desmutting processing is carried out after washing with water in order to remove smut, because the smut is formed on the surface of the aluminium by electrochemical graining. Such desmutting processing is carried out by bringing the surface of an aluminium plate into contact with an aqueous solution of acid or alkali by a method such as immersion processing, etc. As the acid, there are phosphoric acid, sulfuric acid and chromic acid, et. As the alkali, the same as those used for desmutting processing after chemical graining, as described above, can be used. Particularly desirable desmutting processing include a process which comprises touching with a 15 to 65% by weight sulfuric at a temperature of 50° to 90° C. as described in Japanese Patent Application (OPI) No. 12739/78 and a process which comprises carrying out alkali etching as described in Japanese Patent Publication No. 28123/73.

In the case of carrying alkali etching, it is preferred to remove insoluble substances on the processed surface with phosphoric acid, nitric acid, sulfuric acid, chromic acid or a mixed acid containing two or more of them for the purpose of removing smut formed by alkali etching or neutralizing alkalis.

In the above illustration, aluminium plates having a grained surface suitable as lithographic supports are obtained by combining chemical graining with electrochemical graining. However, it has been found that, when an aqueous solution containing ferric chloride and phosphoric acid is used as an etching solution which is used as an etchant for the chemical graining, aluminium plates having a grained surface suitable as lithographic supports can also be obtained by only the chemical graining. Namely, as etching solutions known hitherto which are used for chemical graining, there are, for example, an aqueous solution containing ferric chloride and nitric acid as described in U.S. Pat. No. 1,776,535 and an aqueous solution containing ferric chloride, hydrochloric acid and aluminium ion as described in British Pat. No. 946,606. However, when the surface of aluminium plates is subjected to chemical graining with these known etching solutions, there is a disadvantage in that the etching process should be carried out for a long period of time in order to obtain a uniform grained surface or that the parts which are not required for etching (for example, to top part of the grain) are more or less etched to cause deterioration of efficiency, by which a large amount of aluminium is etched. Consequently, the production rate is reduced in industrial practice, and a great burden is required for keeping the composition of the etching solution so as to be in a desired allowable range, which is a great obstacle in industrial use. However, when the above described aqueous solution containing ferric chloride and phosphoric acid is used as an etchant for chemically graining, it has been found that the above described faults in the prior etchants do not occur.

The aluminium plate processed as described above can be used as a lithographic support directly or after subjecting to chemical processing. In case of producing a lithographic printing plate having high printing durability, it is subjected to anodic oxidation.

Anodic oxidation can be carried out by a process which has been carried out hitherto in this field. When a direct current or an alternating current is applied to the aluminium in an aqueous solution or non-aqueous solution containing sulfuric acid, phosphoric acid, chromic acid, oxalic acid, sulfamic acid, benzenesulfonic acid, etc. or a combination of two or more of them, an anodic oxidation film can be formed on the surface of the aluminium support.

Processing conditions for anodic oxidation can not be determined simply, because they vary according to the electrolyte, but it is generally preferred that the concentration of the electrolyte is 1 to 80% by weight, the liquid temperature is 5° to 70° C., the current density is 0.5 to 60 amperes/dm$^2$, the electric voltage is 1 to 100 V, and the electrolysis time is 15 seconds to 50 minutes.

As the anodic oxidation processing, a process which comprises carrying out anodic oxidation in sulfuric acid at a high current density as described in British Pat. No. 1,412,768, and a process which comprises carrying out anodic oxidation using phosphoric acid as an electrolytic bath as described in U.S. Pat. No. 3,511,661, are particularly preferred.

The aluminium plate subjected to anodic oxidation can be additionally processed by a process such as immersion in an aqueous solution of alkali metal silicates such as sodium silicate as described in U.S. Pat. Nos. 2,714,066 and 3,181,461 or can be provided with an undercoat layer of hydrophilic cellulose (for example, carboxymethyl cellulose, etc.) containing water soluble metal salts (for example, zinc acetate, etc.) as described in U.S. Pat. No. 3,860,426.

On the lithographic support obtained as described above, a light-sensitive layer known hitherto is provided as a light-sensitive layer for PS plates (pre-sensitized plate) to produce a light-sensitive lithographic plate. The lithographic plate thus obtained by plate making has excellent performances.

As compositions of the above described light-sensitive layer, there are the following.

(1) A light-sensitive layer composed of a diazo resin and a binder:

As negative working light-sensitive diazo compounds, condensation products of diphenylamine-p-diazonium salt and formaldehyde (the so-called light-sensitive diazo resin) which are reaction products of diazonium salt with an organic condensating agent containing a reactive carbonyl group such as aldol, acetal, etc., as disclosed in U.S. Pat. Nos. 2,063,631 and 2,667,415, are suitably used. Other useful condensation diazo compounds have been disclosed in Japanese Patent Publication Nos. 48001/74, 45322/74 and 45323/74. These types of light-sensitive diazo compounds are obtained generally in a form of a water soluble inorganic salt. Accordingly, they can be applied using an aqueous solution. Further, it is possible to use substantially water-insoluble light-sensitive diazo resins which are reaction products obtained by reacting the water soluble diazo compound with an aromatic or aliphatic compounds having one or more of phenolic hydroxyl groups and sulfonic acid groups or both by a process idsclosed in Japanese Patent Publication No. 1167/72.

It is also possible to use reaction products of it with hexafluorophosphate or tetrafluoroborate as described in Japanese Patent Application (OPI) No. 121031/81.

Examples of the reacting substances having phenolic hydroxyl groups include hydroxybenzophenone, 4,4-bis-(4'-hydroxyphenyl)pentanoic acid, resorcinol and diphenolic acids such as diresorcinol, which may have substituents. Examples of hydroxybenzophenones include 2,4-dihydroxybenzophenone, 2-hydroxy-4-methoxybenzophenone, 2,2'-dihydroxy-4, 4'-dimethoxybenzophenone and 2,2',4,4'-tetrahydroxybenzophenone. As preferred sulfonic acids, there are, for example, aromatic sulfonic acids such as sulfonic acid of benzene, toluence, xylene, naphthalene, phenol, naphthol or benzophenone, etc. and soluble salts of them such as ammonium or alkali metal salts. The sulfonic acid group containing compounds may be substituted by a lower alkyl group, a nitro group, a halo group and/or an additional sulfonic acid group. Preferred examples of such compounds include benzenesulfonic acid, toluenesulfonic acid, naphthalenesulfonic acid, 2,5-dimethylbenzenesulfonic acid, sodiumbenzenesulfonate, naphthalene-2-sulfonic acid, 1-naphthol-2(or 4)-sulfonic acid, 2,4-dinitro-1-naphthol-7-sulfonic acid, 2-hydroxy-4-methoxybenzophenone-5-sulfonic acid, sodium m-(p'-anilinophenylazo)benzenesulfonate, alizarinsulfonic acid, o-toluidine-m-sulfonic acid, ethanesulfonic acid, etc. Alcohol sulfonic acid esters and salts thereof are useful, as well. Such compounds can be easily available as anionic surface active agents. Examples of them include ammonium and alkali metal salts of lauryl sulfate, alkylaryl sulfate, p-nonylphenyl sulfate, 2-phenylethyl sulfate, isooctylphenoxydiethoxyethyl sulfate, etd.

These substantially water-insolubel light-sensitive diazo resins are separated as precipitates by blending a water soluble light-sensitive diazo resin with an aqueous solution of the above described aromatic or aliphatic compound so as to be in nearly equal amounts.

Further, diazo resins described in British Pat. No. 1,312,925 are preferred.

The most suitable diazo resin in 2-methoxy-4-hydroxy-5-benzoylbenzene sulfonic acid salts of a condensate of p-diazodiphenylamine and formaldehyde.

The diazo resin is preferred to be contained in the light-sensitive layer in an amount of 5 to 50% by weight. If the amount of the diazo resin is small, the light-sensitivity naturally increases, but the stability over the course of time deteriorates. An optimum amount of the diazo resin is about 8 to 20% by weight.

On the other hand, as binders, various high plymer compounds can be used. In the present invention, those containing groups such as hydroxyl, amino, carboxyl, amide, sulfonamide, active methylene, thioalcohol or epoxy, etc. are desirable. Examples of such binders include shellac described in British Pat. No. 1,350,521, polymers containing a hydroxyethyl acrylate unit or hydroxyethyl methacrylate unit as a main repeating unit, as described in British Pat. No. 1,460,978 and U.S. Pat. No. 4,123,276, polyamide resin described in U.S. Pat. No. 3,751,257, phenol resins and polyvinyl acetal resins such as polyvinyl formal resin or polyvinyl butyral resin described in British Pat. No. 1,074,392, linear polyurethane resins described in U.S. Pat. No. 3,660,097, phthalated polyvinyl alcohol resins, epoxy resin prepared by condensation of bisphenol A and epichlorohydrin, amino group containing polymers such as polyaminostyrene or polyalkylamino acrylate (methacrylate), cellulose derivatives such as cellulose acetate, cellulose alkyl ethers, cellulose acetate phthalate, etc., and the like.

To the compositions composed of a diazo resin and a binder, pH indicators described in British Pat. No. 1,041,463 or additives such as phosphoric acid or dyes, etc. described in U.S. Pat. No. 3,236,646 can be added.

(2) A light-sensitive layer composed of an o-quinonediazide compound:

Preferred o-quinonediazide compounds are o-naphthoquinonediazide compounds, examples of them have been described in many literatures including, for example, U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709 and 3,647,443, and they can be suitably used. Of these, o-naphthoquinonediazide sulfonic acid esters or o-naphthoquinonediazide carboxylic acid esters of aromatic aminocompounds and o-naphthoquinonediazide sulfonamides or o-naphthoquinonediazide carbonamides of aromatic hydroxyl compounds are particularly preferred. Particularly, those obtained by esterification reaction of o-naphthoquinonediazide sulfonic acid with a condensate of pyrogallol and acetone, described in U.S. Pat. No. 3,635,709, those obtained by esterification reaction of o-naphthoquinonediazide sulfonic acid or o-naphthoquinonediazide carboxylic acid with an end-hydroxyl group containing polyester, described in U.S. Pat. No. 4,028,111, those obtained by esterification reaction of o-naphthoquinonediazide sulfonic acid or o-naphthoquinonediazide carboxylic acid with a homopolymer of p-hydroxystyrene or a copolymer of p-hydroxystyrene and other copolymerizable monomers, described in British Pat. No. 1,494,043, and those obtained by amidation reaction of o-naphthoquinonediazide sulfonic acid or o-naphthoquinonediazide carboxylic acid with a copolymer of p-aminostyrene and other copolymerizable monomers, described in U.S. Pat. No. 3,759,711, are remarkably preferred.

Those o-quinonediazide compounds can be used alone, but it is preferable to use them together with an alkali soluble resin. As suitable alkali soluble resins, there are novolak phenol resins, examples of which include phenol formaldehyde resin, o-cresol formaldehyde resin or m-cresol formaldehyde resin, etc. It is more suitable to use the above described phenol resin together with a condensate of phenol or cresol substituted by an alkyl group having 3 to 8 carbon atoms and formaldehyde, such as t-butylphenol-formaldehyde resin, as described in U.S. Pat. No. 4,123,279. The alkali soluble resin is incorporated in an amount of about 50 to about 85% by weight, preferably 60 to 80% by weight, based on the entire weight of the composition composing the light-sensitive layer.

An optimum amount of the o-quinonediazide compound is about 15 to 50 wt %, more preferably about 20 to 40 wt %.

To the light-sensitive composition composed of the o-quinonediazide compound, it is possible to add, if necessary, additives such as dyes, plasticizers or components which gives a printing-out performance as described in, for example, British Pat. Nos. 1,041,463 and 1,039,475 and U.S. Pat. No. 3,969,118.

(3) A light-sensitive laye composed of an azide compound and a binder (high plymer compound):

For example, there are compositions composed of an azide compound and a water soluble or alkali soluble high plymer compound, as described in British Pat. Nos. 1,235,281 and 1,495,861 and Japanese Patent Application (OPI) Nos. 32331/76 and 36128/76, and compositions composed of an azide group containing plymer and a high polymer compound of the binder, as described in Japanese Patent Application (OPI) Nos. 5102/75, 84302/75, 84303/75 and 12984/78.

(4) Other light-sensitive resin layers:

For example, there are polyester compounds as disclosed in Japanese Patent Application (OPI) No. 96696/77, polyvinyl cinnamate resins described in British Pat. Nos. 1,112,277, 1,313,390, 1,341,004 and 1,377,747, and light-polymerization type photo-polymer compositions as described in U.S. Pat. Nos. 4,072,528 and 4,072,527.

The amount of the light-sensitive layer provided on the support is in a range of about 0.1 to about 7 g/m$^2$, preferably 0.5 to 4 g/m$^2$.

After the PS plate is imagewise exposed to light, it is subjected to processing including development by the conventional manner, by which a resin image is formed. For example, in the case of a PS plate having the above described light-sensitive layer (1), it is processed with a developing solution as described in, for example, U.S. Pat. No. 4,186,006 after imagewise exposed to light, by which the light-sensitive layer of the nonexposed part is removed by development to obtain a lithographic plate. In the case of a PS plate having a light-sensitive layer (2), after imagewise exposed to light, it is developed with an aqueous solution of alkali as described in U.S. Pat. No. 4,259,434, by which the nonexposed part is removed to obtain a lithographic plate.

According to the present invention, a lithographic support having good grains can be produced without using special aluminum alloys as described in Japanese Patent Application (OPI) No. 61304/76, in spite of utilizing the chemical graining process.

Further, in the process of the present invention, the problem of the non-homogeneous grains due to abrasion by brush does not occur, since brush graining is not employed. Further, continuous production is excellent for a long time, because only the composition of the etching solution should be controlled. Moreover, it has been found to have an unexpected effect that a lithographic plate having less stain on the nonimage part can be obtained as compared with a support produced by a combination of brush-graining and electrochemical graining as described in Japanese Patent Application (OPI) No. 123204/78.

In the following, the present invention is illustrated in greater detail with reference to non-limiting examples. Unless otherwise stated, "%" means "% by weight".

EXAMPLE 1

After an aluminium plate (material: JIS A1050) having a thickness of 0.24 m/m was subjected to chemical graining by immersing in an aqueous solution containing 30% of ferric chloride and 50% of phosphoric acid at 50° C. so as to have an average surface roughness of the center line of 0.50 μm, it was immersed in a 10% aqueous solution of sodium hydroxide at 50° C. for 10 seconds to remove smut formed by chemical graining. Further, it was neutralized and washed with 20% nitric acid to remove insoluble residues on the surface, and washed with water. It was then subjected to electrolytic graining with an aqueous solution of nitric acid having a concentration of 7 g/l as an electrolyte using an alternating wave form electric current shown in FIG. 2.

The electrochemical graining was carried out under such an electrolytic condition that frequency=60 Hz, $V_A$=25 volts, $V_C$=13 volts, the quantity of anode time electricity $Q_A$=176 coulombs/dm$^2$, the quantity of cathode time electricity $Q_C$=125 coulombs/dm$^2$ ($Q_C/Q_A$=0.71). After it was immersed in a 10% aqueous solution of sodium hydroxide at 50° C. for 10 seconds to remove smut formed by electrochemical graining, it was subjected to anodic oxidation in a 18% aqueous solution of sulfuric acid so as to result in a weight of the oxidation film of 1.5 g/m$^2$. After wshing with water, it was immersed in a 2% aqueous solution of sodium silicate at 70° C. for 1 minute, washed with water and dried to prepare support (1).

To the resulting support, a light-sensitive solution having the following composition was applied and dried to provide a light-sensitive layer. The dry coated amount of the light-sensitive layer was 2.0 g/m$^2$.

Light-sensitive solution:

N-(4-Hydroxyphenyl)methyacrylamide/2-hydroxyethyl methacrylate/acrylonitrile/methyl methacrylate/methacrylic acid (molar ratio: 15:10:30:38:7) copolymer (average molecular weight: 60000): 5.0 g;

Hexafluorophosphate of a condensate of 4-diazodiphenylamine and formaldehyde: 0.5 g;

Phosphorous acid: 0.05 g;

Victoria Pure Blue BOH (Hodogaya Chemical): 0.1 g;

2-Methoxyethanol: 100 g.

After the light-sensitive lithographic plate produced as described above was exposed to light through a negative transparent film in a vacuum printer using a 3 KW metal halide lamp at a distance of 1 m for 50 seconds, it was developed with a developing solution having the following composition and subjected to gumming with an aqueous solution of gum arabic to obtain a lithographic plate.

Developing solution:

Sodium sulfite: 5 g;

Benzyl alcohol: 30 g;

Sodium carbonate: 5 g;

Sodium isopropylnaphthalenesulfonate: 12 g;

Pure water: 1000 g.

Using the printing plate produced as described above, printing was carried out by a conventional procedure. The results are shown in Table 1 described later.

EXAMPLE 2

Chemical graining was carried out in the same manner as in Example 1. After it was desmutted with alkali, neutralized with nitric acid and washed with water, it was subjected to anodic oxidation processing in a 18% aqueous solution of sulfuric acid so as to result in an amount of the oxidation film of 1.5 g/m$^2$. After washing with water, it was immersed in a 2% aqueous solution of sodium silicate at 70° C. for 1 minute, washed with water and dried to prepare support (2). Application of a light-sensitive layer, exposure to light, development, gumming and printing were carried out in the same manner as in Example 1. The results obtained are shown in Table 1 described later.

EXAMPLE 3

After an aluminium plate (material: JIS A1050) having a thickness of 0.24 m/m was subjected to chemical graining by immersing in an aqueous solution containing 10% of ammonium fluoride and 5% of ammonium sulfate at 50° C. so as to have an average surface roughness of the center line of 0.5 μm, it was processed by immersing in a 10% aqueous solution of sodium hydroxide at 50° C. for 10 seconds to remove smut formed by chemical graining. It was then subjected to electrolytic graining with an aqueous solution of nitric acid having a concentration of 7 g/l as an electrolyte in the same manner as in Example 1. Removal of smut, anodic oxidation processing, processing with 2% sodium silicate and washing with water were carried out in the same manner as in Example 1 to prepare a support (3). Application of a light-sensitive layer, exposure to light, development, gumming and printing were carried out in the same manner as in Example 1. The results obtained are shown in Table 1 described later.

EXAMPLE 4

After an aluminium plate (material: JIS A1050) having a thickness of 0.24 m/m was subjected to chemical graining by immersing in an aqueous solution containing 2% of hydrogen fluoride and 4% of nitric acid at 50° C. so as to have an average surface roughness of the center line of 0.5 μm, it was processed by immersing in a 10% aqueous solution of sodium hydroxide at 50° C. for 10 seconds to remove smut formed by chemical graining. It was then subjected to electrolytic graining with an aqueous solution of nitric acid having a concentration of 7 g/l as an electrolyte in the same manner as in Example 1. After smut formed by electrolytic graining processing was removed by immersing in a 15% aqueous solution of sulfuric acid at 50° C. for 3 minutes, it was subjected to anodic oxidation in a 18% aqueous solution of sulfuric acid so as to result in a weight of the oxidation film of 1.5 g/m$^2$, washed with water and dried to prepare a support (4).

To the resulting support, a light-sensitive solution having the following composition was applied and dried to provide a light-sensitive layer. The dry coated amount of the light-sensitive layer was 2.0 g/m$^2$.

Naphthoquinone-1,2-diazide(2)-5-sulfonic acid ester of acetone-pyrogallol resin (synthesized according to the process described in U.S. Pat. No. 3,635,709): 5 g;
Tertiary-butylphenol-formaldehyde resin: 0.5 g;
Cresol-formaldehyde resin: 5 g;
Methyl ethyl ketone: 50 g;
Cyclohexanone: 40 g.

After the light-sensitive lithographic plate produced as described above was exposed to light through a positive transparency in a vacuum printer using a 3 KW metal halide lamp for 30 seconds, it was developed with a 5.26% solution of sodium silicate of $SiO_2/Na_2O=1.74$ (pH=12.7) and subjected to gumming with a 14° Baume aqueous solution of gum arabic. Using the resulting printing plate produced as described above, printing was carried out by an conventional procedure. The results are shown in Table 1 described later.

COMPARATIVE EXAMPLE 1

An aluminium plate (material: JIS A1050) having a thickness of 0.24 m/m was subjected to graining by means of a revolving nylon brush with pouring a suspension of pumice having a particle size 400 meshes in water so as to have an average surface roughness of the center line of 0.50 μm.

The aluminium plate mechanically grained as described above was immersed in a 10% aqueous solution of sodium hydroxide at 50° C. for 60 seconds to remove the abrasive and aluminium scraps cutting into the surface of aluminium by the graining processign so that the surface became uniform. Thereafter, it was washed with flowing water. Then, it was neutralized and washed with 20% nitric acid to remove insoluble residues on the surface, and washed with water. After it was subjected to anodic oxidation in a 18% aqueous solution of sulfuric acid so as to result in an amount of the oxidation film of 1.5 g/m$^2$, it was immersed in a 2% aqueous solution of sodium silicate at 70° C. for 1 minute, washed with water and dried to prepare a support (A). Application of a light-sensitive layer, exposure to light, development, gumming and printing were carried out in the same amnner as in Example 1. The results obtained are shwon in Table 1 described later.

COMPARATIVE EXAMPLE 2

After an aluminium plae (material: JIS A1050) having a thickness of 0.24 m/m was processed by immersing in a 10% aqueous solution of sodium hydroxide at 50° C. for 30 seconds to carry out degreasing, it was desmutted with 20% nitric acid, and washed with water. Then, it was electrochemically grained with an aqueous solution of nitric acid having a concentration of 7 g/l as an electrolyte using an alternating wave form electric current shown in FIG. 2. The graining was carried out for 5 seconds under such an electrolytic condtion that the frequency=60 Hz, $V_A=25$ volts, $V_C=13$ volts, the quantity of anode time electricity $Q_C=176$ coulombs/dm$^2$ and the quantity of cathode time electricity=125 coulombs/dm$^2$ ($Q_C/Q_A=0.71$).

After it was immersed in a 10% aqueous solution of sodium hydroxide at 50° C. for 10 seconds to remove smut formed by electrochemical graining, it was subjected to anodic oxidation in a 18% aqueous solution of sulfuric acid so as to result in an amount of the oxidation film of 1.5 g/m$^2$. After it was washed with water, it was immersed in a 2% aqueous solution of sodium silicate at 70° C. for 1 minute, washed with water and dried to prepare a support (B). The procedure for application of a light-sensitive layer to plate making and printing was carried out in the same manner as in Example 1. The results obtained are shown in Table 1 described later.

COMPARATIVE EXAMPLE 3

An aluminium plate grained by brush graining in the same manner as in Comparative Example 1 was immersed in a 10% aqueous solution of sodium hydroxide at 50° C. for 60 seconds to remove the abrasive and aluminium scraps cutting into the surface of aluminium by the graining processing so that the surface became uniform. Thereafter, it was washed with flowing water. It was then neutralized and washed with 20% nitric acid to remove insoluble residues on the surface, and, thereafter, it was subjected to electrolytic graining with an aqueous solution of nitric acid having a concentration of 7 g/l as an electrolyte using an alternating wave form electric current shown in FIG. 2. The electrochemical graining was carried out under such an electrolytic condtion that the frequency=60 Hz, $V_A=25$ volts, $V_C=13$ volts, and the quantity of anode time electricity $Q_a=176$ coulombs/dm$^2$. After it was immersed in a 10% aqueous solution of sodium hydroxide at 50° C. for 10 seconds to remove smut formed by electrochemcial graining, it was subjected to anodic oxidation in a 18% aqueous solution of sulfuric acid so as to result in a weight of the oxidation film of 1.5 g/m$^2$.

After washing with water, it was immersed in a 2% aqueous solution of sodium silicate at 70° C. for 1 minute, washed with water and dried to prepare a support (C). Application of a light-sensitive layer, exposure to light, development, gumming and printing were carried out in the same manner as in Example 1. The results obtained are shown in Table 1. described later.

TABLE 1

| Support | Example 1 (1) | Example 2 (2) | Example 3 (3) | Example 4 (4) | Comparative Example 1 (A) | Comparative Example 2 (B) | Comparative Example 3 (C) |
|---|---|---|---|---|---|---|---|
| Etching for chemical graining | Ferric chloride | Ferric chloride | Ammonium fluroide | Nickel chloride | None | None | None |
| | Phosphoric acid | Phosphoric acid | Ammonium sulfate | Hydrogen fluoride | None | None | None |
| | | | | Boric acid | None | None | None |
| Mechanical graining | None | None | None | None | Yes | None | Yes |
| Electrochemical graining | Yes | None | Yes | Yes | None | Yes | Yes |
| Desmutting processing | Sodium hydroxide | Sodium hydroxide | Sodium hydroxide | Sulfuric acid | Sodium hydroxide | Sodium hydroxide | Sodium hydroxide |
| Light-sensitive layer | Negative working | Negative working | Negative working | Positive working | Negative working | Negative working | Negative working |
| Stain on nonion age part (Note) | Excellent | Excellent | Excellent | Excellent | Inferior | Excellent | Inferior |
| Printing durability | 100,000 | 80,000 | 100,000 | 100,000 | 80,000 | 50,000 | 100,000 |

Note:
Stain on nonimage part: Excellent: Stain of blanket hardly occurs. Inferior: Stain of blanket is great. In special cases, the nonimage part of prints is stained.

It is understood from the results shown in Table 1 that, in the case of carrying out only chemical graining as a method of graining, stain of nonimage part is excellent, but printing durability is inferior, and, in the case of carrying out only brush graining (namely, mechanical graining), both the stain of the nonimage part and the printing durability are inferior to those of the present invention. In the case of carrying out only electrochemical graining, the stain of the nonimage part is excellent, but the printing durability is inferior. Further, it is understood that, in the case of combining brush braining with electrochemical graining, the stain of the nonimage part is inferior to that of the present invention.

EXAMPLE 5

After an aluminium plate (material: JIS A1050) having a thickness of 0.24 m/m was degreased with trichlene at room temperature for 60 seconds, it was washed with water and subjected to chemical graining by immersing in an aqueous solution containing 30% of ferric chloride and 50% of phosphoric acid so as to have an average surface roughness of the center line of 0.50 μm. Thereafter it was immersed in a 1% aqueous solution of sodium hydroxide at 50° C. for 10 seconds to remove smut formed by chemical graining. Further, it was processed with 20% nitric acid to remove insoluble residues on the surface and washed with water.

It was then electrochemically grained in the same manner as in Example 1. After carrying out desmutting, it was immersed in a 2% aqueous solution of sodium silicate at 70° C. for 1 minute, washed with water and dried to prepare a support (5).

To the support (5), a light-sensitive solution shown in Example 1 was applied. Plate making and printing were carried out in the same manner as in Example 1.

Printing was carried out by attaching the resulting printing plate to an offset printing press, thereby obtaining excellent printed matters having no background contamination.

EXAMPLE 6

An aluminium plate (material: JIS A1050) having a thickness of 0.24 m/m was chemically grained by immersing in an aqueous solution containing 30% of ferric chloride and 50% of phosphoric acid at 50° C. so as to have an average surface roughness of the center line of 0.50 μm. It was then immersed in a 10% aqueous solution of sodium hydroxide at 50° C. for 10 seconds to remove smut formed by the above described graining. Further, it was neutralized and washed with 20% nitric acid to remove insoluble residues, and washed with water. After it was subjected to anodic oxidation in a 18% aqueous solution of sulfuric acid so as to result in an amount of the oxidation film of the oxidation film of 1.5 g/m$^2$, it was washed with water, and it was then immersed in a 2% aqueous solution of sodium silicate at 70° C. for 1 minute, washed with water and dried to prepare a support (6).

To the support obtained as described above, a light-sensitive solution having the following composition was applied and dried to provide a light-sensitive layer. The dry coated amount of the light-sensitive layer was 2.0 g/m$^2$.

Light-sensitive solution:

N-(4-Hydroxyphenyl)methacrylamide/2-hydroxyethyl methacrylate/acrylonitrile/methyl methacrylate/-methacrylic acid (molar ratio: 15:10:30:38:7) copolymer (average molecular weight: 60000): 5.0 g;

Hexafluorophosphate of a condensate of 4-diazodiphenylamine and formaldehyde: 0.5 g;

Phosphorous acid: 0.05 g;

Victoria Pure Blue BOH (Hodogaya Chemical): 0.1 g;

2-Methoxyethanol: 100 g.

After the light-sensitive lithographic plate produced as described above was exposed to light through a negative transpatency in a vacuum printer using a 3 KW metal halide lamp at a distance of 1 m for 50 seconds, it was developed with a developing solution having the following composition and subjected to gumming with an aqueous solution of gum arabic to obtain a lithographic plate.

Developing solution:

Sodium sulfite: 5 g;

Benzyl alcohol: 30 g;

Sodium carbonate: 5 g;

Sodium isopropylnaphthalenesulfonate: 12 g;

Pure water: 1000 g.

Using the printing plate produced as described above, printing was carried out by an ordinary procedure. The results obtained are shown in Table 2 described later.

COMPARATIVE EXAMPLE 4

A support (D) was produced in the same manner as in Example 6, except that an aqueous solution containing 30% of ferric chloride and 20% of hydrochloric acid was used as a etching solution for chemical graining. Using this support, application of a light-sensitive layer, exposure to light, development, gumming and printing were carried out in the same manner as in Example 6. The results obtained are shown in Table 2 described later.

COMPARATIVE EXAMPLE 5

An aluminium plate having a thickness of 24 m/m was mechanically grained by a revolving nylon brush in a suspension of pumice having a particle size of 400 meshes in water. The grained aluminium plae was immersed in a 10% aqueous solution of sodium hydroxide at 50° C. for 60 seconds to remove the abrasive and aluminium scraps cutting into the surface of the aluminium by the graining processing so that the surface became uniform. Thereafter, it was washed with flowing water, and it was neutralized and washed with 20% nitric acid and washed with water. After it was subjected to anodic oxidation in a 18% aqueous solution of sulfuric acid so as to result in an amount of the oxidation film of 1.5 g/m$^2$, it was immersed in a 2% aqueous solution of sodium silicate at 70° C. for 1 minute, washed with water and dried to prepare a support (E). Application of a light-sensitive layer, exposure to light, development, gumming and printing were carried out in the same manner as in Example 6. The results obtained are shown in Table 2 described later.

TABLE 2

| Support | Example 6 (6) | Comparative Example 4 (D) | Comparative Example 5 (E) |
|---|---|---|---|
| Reduction of weight of the support based on the case of no processing (g/m$^2$) | 10 | 20 | 10 |
| Stain on nonimage part* | A | B | C |
| Printing durability (number of sheet) | 80,000 | 80,000 | 80,000 |

* A . . . Stain does not occur, even if printing conditions (feed amount of wetting solution, tack value of ink, printing pressure, etc.) vary.
B . . . Slight stain occures depending upon printing conditions.
C . . . Stain occurs by some variation of printing conditions.

It is understood from the results shown in Table 2 that, in the case of the support according to the present invention, reduction of the weight of the support is smaller than that of Comparative Example 4. This fact means that the reduction of thickness by chemical graining is small. Further, it is understood that, in the support according to the present invention, the nonimage part of the printing plate is hard to stain as compared with the support of Comparative Example 5.

EXAMPLE 7

An aluminium plate (material: JIS A1050) having a thickness of 0.24 m/m was chemically grained by processing in an aqueous solution containing 40% of ferric chloride and 60% of phosphoric acid at 50° C. so as to have an average roughness of the center line of 0.55 μm. It was then immersed in a 1% aqueous solution of sodium hydroxide at 50° C. for 10 seconds to remove smut formed by the above described graining. After it was neutralized and washed with 20% nitric acid to remove insoluble residues, it was washed with water, and it was immersed in a 1.5% aqueous solution of sodium silicate at 70° C. for 30 seconds, washed with water and dried to prepare a support (7).

To the support obtained as described above, a light-sensitive solution having the following composition was applied, and dried to provide a light-sensitive layer. The dry coated amount of the light-sensitive layer was 1.5 g/m$^2$.

Light-sensitive solution:

Ester compound composed of naphthoquinone-1,2-diazido-5-sulfonyl chloride and pyrogalloacetone resin (that described in U.S. Pat. No. 3,635,709 as Example 1): 0.75 parts;
Cresol novlak resin: 2.00 parts;
Tetrahydrophthalic anhydride: 0.15 parts;
Oil Blue 603 (Orient Chemical Co): 0.04 parts;
o-Naphthoquinonediazide-4-sulfonic acid chloride: 0.04 parts;
Ethylene dichloride: 16 parts;
2-Methoxythyl acetate: 12 parts.

After the light-sensitive lithographic plate produced as described above was exposed to light through a positive transparent image using a 2 KW metal halide lamp as a light source at a distance of 1 m for 60 seconds, it was developed with a developing solution (liquid temperature 25° C.) having the following composition, followed by gumming.

Sodium metasilicate: 90 g;
JIS No. 3 sodium silicate: 4 g;
Water: 1000 g;

Printing was carried out using this printing plate, and printing durability and degree of stain on the nonimage part were examined. The results are shown in Table 3 described later.

COMPARATIVE EXAMPLE 6

A support (F) was produced in the same manner as in Example 7, except that an aqueous solution containing 40% of ferric chloride and 40% of nitric acid was used as a etching solution for chemical graining. Using this support, application of a light-sensitive layer, exposure to light, development, gumming and printing were carried out in the same manner as in Example 7. The result obtained is shown in Table 3 described later.

TABLE 3

| Support | Example 7 (7) | Comparative Example 6 (F) |
|---|---|---|
| Reduction of weight of the support based on the case of no processing (g/m$^2$) | 11 | 25 |
| Stain on nonimage part* | A | B |
| Printing durability (number of sheet) | 20,000 | 10,000 |

*Evaluation is based on the same standard as that shown in Table 2

It is understood from the results shown in Table 3 that, in the case of the support according to the present invention, the reduction of weight is small, namely the reduction of thickness due to chemical graining is small, as compared with the case of Comparative Example 6, and the nonimage part is hard to stain and printing durability is excellent.

While the invention has been described in detail and with reference to specific embodiment thereof, it will be apparent to one skilled in the art that various changes and modifications can be made therein without departing from the spirit and scope thereof.

What is claimed is:

1. A process of preparing a lithographic support which comprises chemically graining at least one surface of an aluminum plate with an aqueous solution containing chloride, fluoride or a mixture thereof wherein the fluoride is selected from the group consisting of, ammonium fluoride, sodium fluoride, silicon fluoride or fluoroboric acid, and wherein the chloride is selected form the group consisting of ferric chloride, ammonium chloride, calcium chloride, nickel chloride, sodium chloride and copper chloride and thereafter electrochemically graining said surface using alternating current in an acid electrolyte selected from hydrochloric acid, nitric acid, or a mixture thereof.

2. The process according to claim 1, wherein the chemical graining is carried out so as to have a surface roughness of the center line of 0.3 to 1.0 μm.

3. The process of preparing a lithographic support according to claim 1, which further comprises carrying out anodic oxidation.

4. A lithographic support produced by the process of claim 1.

5. A presensitized plate comprising a lithographically suitable light-sensitive coating on the lithographic support prepared by the process of claim 1.

6. The process according to claim 1, wherein the aqueous solution further contains an inorganic acid selected from the group consisting of nitric acid, sulfuric acid and hydrochloric acid.

7. The process according to claim 1, wherein the aqueous solution further contains an acid selected from the group consisting of phosphoric acid, sulfuric acid and nitric acid.

8. The process according to claim 1, wherein the aqueous solution contains ferric chloride and phosphoric acid.

9. The process according to claim 1, wherein the fluoride or chloride is present in an amount of 30 to 80% by weight.

10. The process according to claim 1, wherein the fluoride or chloride is present in an amount of 10 to 60% by weight.

11. The process according to claim 6, wherein the acid is present in an amount of 0.1 to 70% by weight.

12. The process according to claim 7, wherein the acid is present in an amount of 0.1 to 70% by weight.

13. The process according to claim 8, wherein the ferric chloride is present in an amount of 20 to 60% by weight and the phosphoric acid is present in an amount of 10 to 80% by weight.

14. The process according to claim 13, wherein the phosphoric acid is present in an amount of 40 to 70% by weight.

15. The process according to claim 1, wherein the aqueous solution is at a temperature of 20° C. to 100° C. and processing is for 10 to 120 seconds.

16. The process according to claim 1, wherein the alternating electric current is in an asymmetric alternating wave form and is applied in such a manner that the quantity of anode time electricity is larger than the quantity of cathode time electricity.

17. The process according to claim 16, wherein the ratio of cathode time electricity/anode time electricity is from 0.3 to 0.95.

18. The process according to claim 17, wherein the voltage is about 1 volt to about 50 volts, the current density is about 10 amperes/$dm^2$ to about 100 amperes/$dm^2$ and the quantity of anode time electricity is about 10 coulombs/$dm^2$ to about 3,000 coulombs/$dm^2$, the temperature of the electrolyte used for the anodic oxidation being about 10° C. to about 45° C.

* * * * *